US005526896A

United States Patent [19]

O'Rourke

[11] Patent Number: 5,526,896

[45] Date of Patent: Jun. 18, 1996

[54] RAIL MOUNTED FALL ARREST LINE ANCHOR

[75] Inventor: Michael J. O'Rourke, Beaumont, Canada

[73] Assignee: Surety Manufacturing & Testing Ltd., Edmonton, Canada

[21] Appl. No.: 246,484

[22] Filed: May 19, 1994

Related U.S. Application Data

[63] Continuation of Ser. No. 26,299, Mar. 4, 1993, abandoned.

[51] Int. Cl.[6] ..... A62B 35/00

[52] U.S. Cl. ..... 182/3; 182/36

[58] Field of Search ..... 182/3, 36, 45; 248/228, 72, 222.4

[56] References Cited

U.S. PATENT DOCUMENTS

| | | | |
|---|---|---|---|
| 2,765,139 | 10/1956 | White | 248/228 |
| 2,916,244 | 12/1959 | Renfroe | 248/228 |
| 3,159,368 | 12/1964 | Ahlbin | 248/222.4 |
| 3,217,833 | 11/1965 | Smith . | |
| 3,977,801 | 8/1976 | Murphy | 248/222.4 |
| 4,606,430 | 8/1986 | Roby et al. . | |
| 4,767,091 | 8/1988 | Cuny | 182/3 X |
| 5,156,233 | 10/1992 | Olsen et al. . | |

FOREIGN PATENT DOCUMENTS

| | | | |
|---|---|---|---|
| 1229575 | 4/1971 | United Kingdom | 482/35 |
| 1326166 | 8/1973 | United Kingdom | 248/228 |

*Primary Examiner*—Alvin C. Chin-Shue

*Attorney, Agent, or Firm*—Sixbey, Friedman, Leedom & Ferguson; Daniel W. Sixbey; Jeffrey L. Costellia

[57] ABSTRACT

A fall arrest line anchor for releasably securing to a rail of a railway. The anchor comprises a pair of plates, each comprising an upper, flat portion and a lower portion curved so that, when the plates are in anchoring position with their flat portions secured together in abutting relationship, the curved portions circumscribe a sufficient portion of the crown of the rail so as to prevent unpurposeful disengagement, a plurality of apertures in the flat portions alignable, when the plates are in anchoring position, to releasably receive means to attach and secure the plates together and a hook of a workmen's fall arrest line.

6 Claims, 2 Drawing Sheets

RAIL MOUNTED FALL ARREST LINE ANCHOR

This application is a continuation of Ser. No. 08/026,299, filed Mar. 4, 1993, now abandoned.

BACKGROUND OF THE INVENTION

The present invention relates to a rail mounted safety restraint device, and more particularly to a worker's fall arrest line anchor for releasably securing to a rail of a railway.

One of the most common activities of railway construction and maintenance workers is that of walking on or passing along an exposed walkway such as exists on any given railway bridge. Increasingly fall arrest systems incorporating restraint lines, lanyards or other such tether devices are being required for railway workers. Such lines, lanyards and tethers will normally be secured, at one end, by way of a hook to a worker's belt or harness, and, at the other, to an anchor device. The major difficulty is that there is often no anchorage point to which a suitable fall arrest system can be attached to give protected freedom of work movement and/or allow unhindered safe passage along a railway bridge. Thus, if the worker were to inadvertently fall off of the bridge or overpass, the fall arrest device, tether or lanyard would break the person's fall and reduce or avoid injury or death to that person.

U.S. Pat. No. 4,606,430 issued Aug. 19, 1986 of Roby et al teaches a rail mounted safety restraint device in the form of a carriage, which is roller mounted to the crown or ball of the rail, and to which carriage one end of a worker's fall arrest cable is attached. The carriage will move along the rail, pulled by the tether, as the worker moves along the rail, without unhooking and re-hooking the tether when changing work locations, yet will tend to stay in place, engaged on the rail, to secure the tether to the rail, in the event of a mis-hap such as the worker inadvertently falling off of a bridge. Such a device however is very heavy and a relatively complicated and expensive construction for an anchor, because of the roller system required.

Another device known to railway workers is a "bridgeman's ring" which loops about the crown of the rail and slides along it. The bridgeman's ring however must be attached at the end of a rail section, thus requiring the track to be unbolted for attachment of the ring to the rail if along an intermediate section of track.

Other patents of general background interest describing and illustrating safety anchors for use with beams are Olsen et al U.S. Pat. No. 5,156,233 issued Oct. 20, 1992 which describes and illustrates an anchor having a roller which slides in a track in a beam, for movement along the beam, and Smith U.S. Pat. No. 3,217,833 issued Nov. 16, 1965 which describes and illustrates an anchor in the form of a pair of interconnected jaws which releasably clamp to a beam, to co-operate with a safety bar, one end of which is secured to the anchor and the other end of which is secured to the belt of a worker.

It is an object of the present invention to provide a simple, lightweight anchor device which may be readily fastened to intermediate sections of rail as an anchor for a worker's fall arrest line. It is a further object of the present invention to provide such an anchor device which will be both secure when in anchoring position but which will be easily releasable for movement to a different location.

SUMMARY OF THE INVENTION

In accordance with the present invention there is provided a worker's fall arrest line anchor for releasably securing to a crown of a rail of a railway. The anchor comprises a pair of plates, each comprising an upper, flat portion and a lower portion curved so that, when the plates are in anchoring position with their flat portions secured together in abutting relationship, the curved portions circumscribe a sufficient portion of the crown of the rail so as to prevent unpurposeful disengagement. A plurality of apertures in the flat portions are alignable, when the plates are in anchoring position, to releasably receive means to attach and secure the plates together and a hook of a workmen's fall arrest line.

In a preferred embodiment of the present invention the attachment and securing means comprise nuts and bolts. The plates have a pair of bolt-receiving apertures, each to receive a bolt, one of the apertures being of elongated and enlarged configuration to facilitate alignment of the plates to receive a bolt therein. In addition, the bolts each have a head of predetermined circumferential size. The elongated aperture of each plate has an enlarged portion of sufficient size to permit passage of the head of the bolt and positioned so that each nut and bolt can be loosened and the plates moved relative to one another and detached when, the bolt heads are positioned within the corresponding enlarged portion.

The anchor according to the present invention provides many advantages over prior art anchor devices. The fact that it can be easily clamped, but to a fixed position on a rail, in many instances is an advantage, particularly where the location may be at the end of a rail and a roller type anchor might be dragged off of the rail in the case of a worker's accident. As well, its construction, while simple and hence economical, permits effective securing in position and releasing of the anchor device on the crown of a rail, very simply by tightening of the nuts and bolts.

BRIEF DESCRIPTION OF THE DRAWINGS

These and other objects and advantages of the invention will become apparent upon reading the following detailed description and upon referring to the drawings in which.

Figure 1:
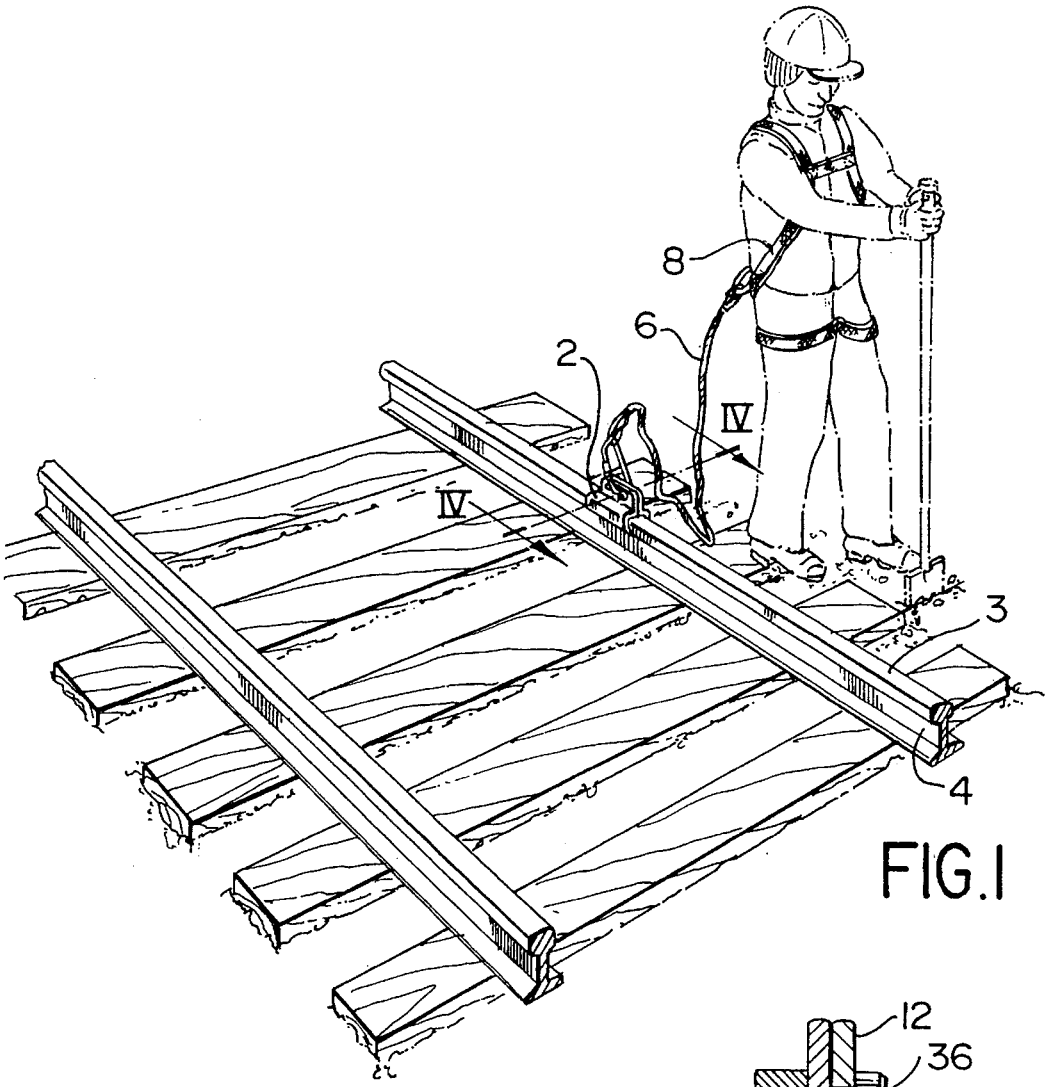
FIG. 1 is a perspective view of an anchor according to the present invention secured in place on the crown of a rail along a track.

While the invention will be described in conjunction with the illustrated embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Turning to FIG. 1, there is illustrated a workmen's fall arrest line anchor 2 in accordance with the present invention, secured to the crown 3 of a rail 4 along a railway, to which is releasably secured one end of a fall arrest line 6, the other end thereof being secured to a belt 8 or harness (not illustrated) of a worker.

Figure 4:
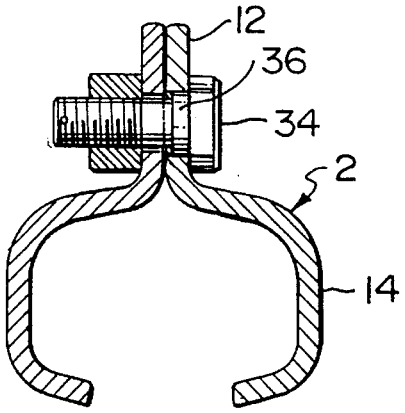
FIG. 4, on the first page of drawings is a side elevation, in section, of the anchor of FIG. 1 along line IV—IV.
Figure 2:
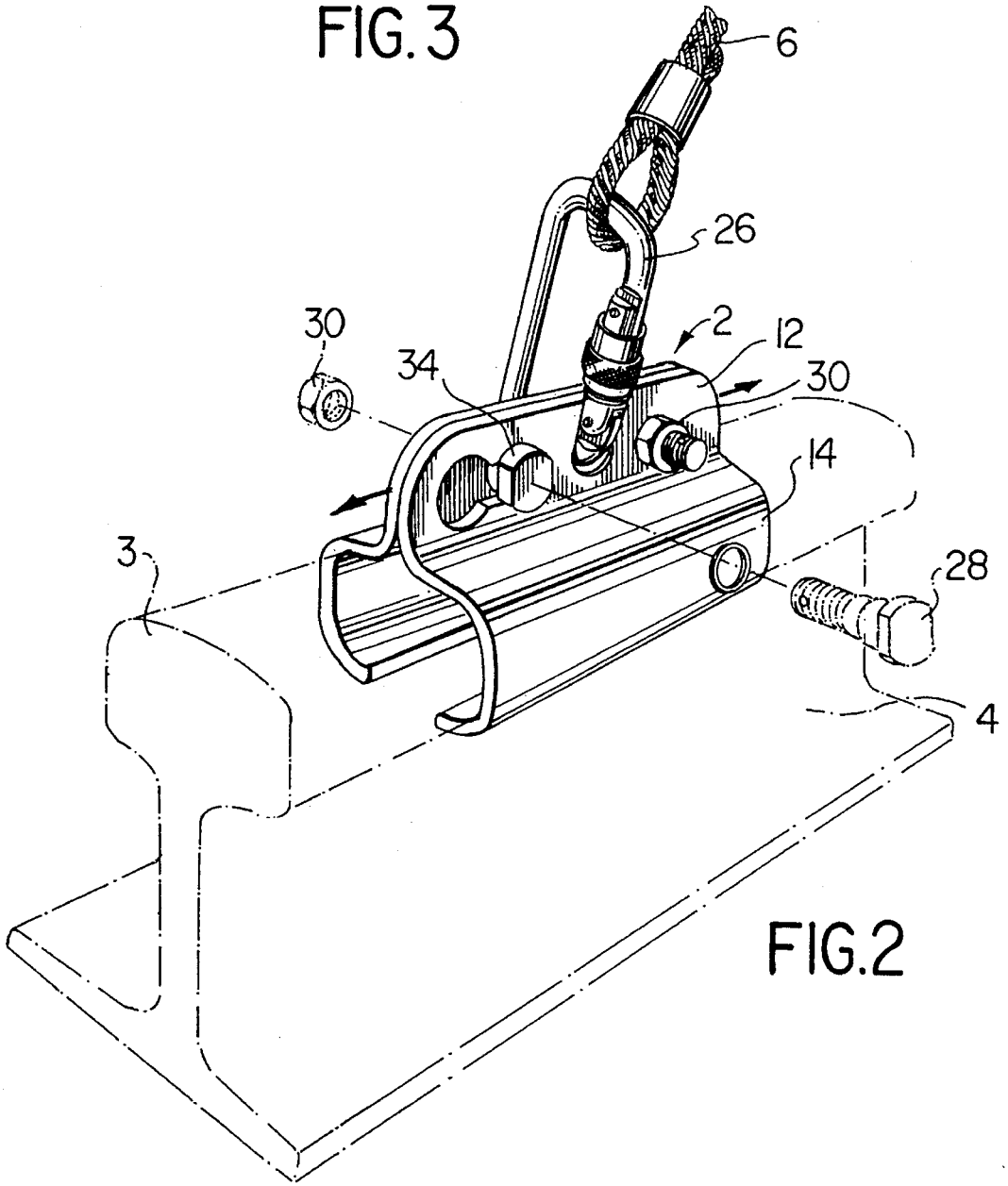
FIG. 2 is an enlarged perspective view of the anchor of FIG. 1, secured to a rail with a fall arrest line hook fastened through it.

As can be seen in FIGS. 2 and 4, anchor 2 comprises a pair of plates 10, each plate comprising an upper flat portion 12 and a lower portion 14 curved as illustrated so that, when plates 10 are in anchoring position as illustrated in FIGS. 2 and 4, their flat portions 12 abut together and their curved portions circumscribe a sufficient portion of the crown 3 of rail 4 so as to prevent unpurposeful disengagement. It is preferred that each of plates 10 be of similar construction. For additional safety, it is further preferred that the corners of the plates be rounded (FIG. 2) and that the edges thereof be bevelled.

Figure 3:
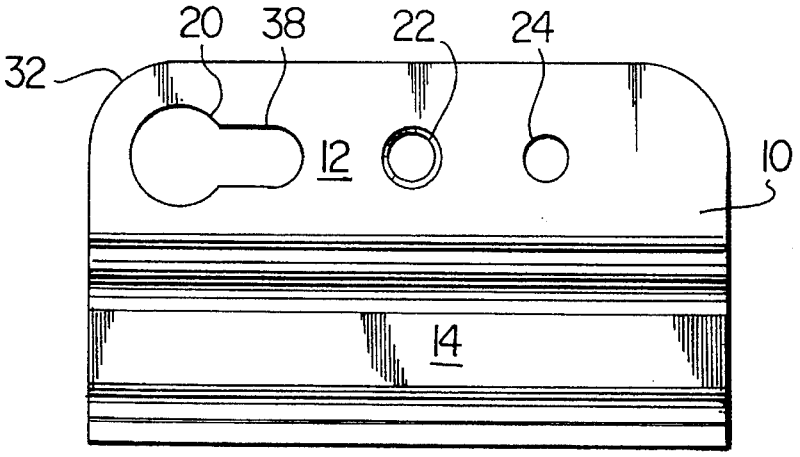
FIG. 3 is a side elevation view of the anchor of FIG. 2.

As can be seen in FIG. 4, upper portion 12 of each plate is provided with an enlarged aperture 20, central aperture 22 and third aperture 24. Since the plates are of similar construction, when the plates are in anchoring position as illustrated in FIGS. 2 and 4, enlarged aperture 20 of one plate will be aligned with third aperture 24 of the other plate, and the central aperture 22 of one plate will be aligned with that of the other. The entrance to each of the central holes 22 is chamfered, as illustrated in FIG. 3. Aperture 22 is positioned to receive the hook (carabiner) 26 of one end of a fall arrester line 6 (FIG. 2). As can be seen in FIG. 2, with hook 26 in position in apertures 22, with the plates in anchoring position as illustrated, the thickness of plates 10 across their abutting upper flat portions 12 is slightly less than the distance between opposing sides of hook 26, whereby, if necessary, hook 26 can assist in resisting release of the plates from anchoring position on a rail.

Apertures 20 and 24, on different plates, with the plates aligned in anchoring position as illustrated in FIGS. 2 and 4, are intended to releasably receive bolts 28, as illustrated, the heads of which, together with nuts 30 attach and secure plates 10 together in anchoring position.

One side 32 of aperture 20 is enlarged, as illustrated, and is of a size and a circumference so as to receive therein the head 34 of bolt 28. Beneath head 34 on bolt 28 is a shoulder 36 (FIG. 4) which fits within the elongated remaining portion 38 of aperture 20. This combination of construction of bolt 28 and construction of enlarged and elongated aperture 20 enables the plates to be loosened to permit dis-engagement of the plates from each other, without having to completely separate the nuts from their corresponding bolts, thereby facilitating the placement and removal of anchor 2 on rail 4. In other words, by sliding one plate 10, (with hook 26 removed) longitudinally with respect to the other plate, head 34 of each bolt can be passed into the corresponding enlarged portion 32 of the associated plate 10, so that that plate 10 can be removed over the head 34 of its associated bolt.

When it is desired to secure a pair of plates in anchoring position on a crown 3 of rail 4, this process is reversed until shoulder 36 is seated within the corresponding elongated portion 38 of its associated aperture 20, at which point head 34 will bear against a portion of its corresponding plate 10, so that the plates 10 are thereby secured together as both nuts 30 are tightened.

In this way, a very simple but effective construction of anchor is provided, with which a minimum of handling by a worker can be attached to the crown of a rail or removed from it. At the same time, when the plates 10 of anchor 2 are in anchoring position, anchor 2 provides an extremely strong grip about the crown 3 of rail 4 and is able to withstand, as a consequence, very strong loads. Its light weight makes it easily portable by a worker or crew.

Thus it is apparent that there has been provided in accordance with the invention a rail mounted fall arrest line anchor that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention is:

1. A worker's fall arrest line rail anchor releasably secured to a crown of a rail of a railway, the anchor comprising a pair of plates, each comprising an upper, flat portion and a lower portion curved so that, when the plates are in anchoring position with their flat portions secured together in abutting relationship, the curved portions conform to and grip a sufficient portion of the crown of the rail so as to prevent unpurposeful disengagement, an elongated aperture having a wide end and a narrow end in the flat portion of each plate located so its wide end is alignable, when the flat portions of the plates are in abutting relationship, to releasably receive the head of a bolt secured to the flat portion of the other plate, the plates relatively slidable into anchoring position with each bolt head from the other plate positioned and overlapping the plate over the narrower end of the corresponding aperture to attach and secure the plates together anchorably gripping the crown, and a further aperture in the flat portion of each plate alignable with its corresponding aperture in the other plate when the plates are in anchoring position releasably receiving a hook of a workman's fall arrest line to prevent the relative movement of the plates and thereby prevent them from separating from their anchoring position.

2. An anchor according to claim 1 wherein each bolt is provided with a shoulder beneath and contiguous to its head, the shoulder to be seated on its corresponding plate within a portion of the corresponding elongated aperture of the other plate when the plates are attached and secured together in anchoring position.

3. An anchor according to claim 1 wherein edges of the plates are bevelled and corners are rounded.

4. An anchor according to claim 1 wherein the hook receiving aperture of each plate has a chamfered entrance to facilitate securing of the hook therein.

5. An anchor according to claim 1 wherein each of the plates is of similar shape.

6. An anchor according to claim 1 wherein the thickness of the flat portions of the plates, when secured together in abutting relationship is slightly less than the distance between confronting inner portions of the fall arrest line to hook.

* * * * *